US010820779B2

(12) United States Patent
Yang et al.

(10) Patent No.: US 10,820,779 B2
(45) Date of Patent: Nov. 3, 2020

(54) WASHING PUMP AND DISHWASHER INCLUDING THE SAME

(71) Applicant: LG Electronics Inc., Seoul (KR)

(72) Inventors: Daebong Yang, Seoul (KR); Minseong Kim, Seoul (KR); Hyungman Park, Seoul (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 16/118,831

(22) Filed: Aug. 31, 2018

(65) Prior Publication Data

US 2019/0059691 A1 Feb. 28, 2019

(30) Foreign Application Priority Data

Aug. 31, 2017 (KR) ..... 10-2017-0111509

(51) Int. Cl.

| | |
|---|---|
| ***A47L 15/42*** | (2006.01) |
| ***F22B 1/28*** | (2006.01) |
| ***F24H 1/12*** | (2006.01) |

(52) U.S. Cl.

CPC ..... *A47L 15/4234* (2013.01); *A47L 15/4219* (2013.01); *A47L 15/4225* (2013.01); *F22B 1/285* (2013.01); *F24H 1/12* (2013.01); *A47L 15/4285* (2013.01); *A47L 2501/06* (2013.01); *A47L 2501/14* (2013.01)

(58) Field of Classification Search

CPC ..... A47L 15/4234

See application file for complete search history.

(56) References Cited

U.S. PATENT DOCUMENTS

| | | | |
|---|---|---|---|
| 2007/0102028 | A1 | 5/2007 | Yoon et al. |
| 2012/0097200 | A1 | 4/2012 | Fountain |
| 2015/0265133 | A1 | 9/2015 | Choi et al. |
| 2017/0188778 | A1 | 7/2017 | Kim et al. |

FOREIGN PATENT DOCUMENTS

| | | |
|---|---|---|
| CN | 104074763 | 10/2014 |
| EP | 3378371 | 9/2018 |
| KR | 1020170016180 | 2/2017 |
| WO | 2016028049 | 2/2016 |
| WO | WO2017022974 | 2/2017 |

OTHER PUBLICATIONS

European Search Report in European Appln. No. 18191623.0, dated Jan. 17, 2019, 9 pages.

PCT International Search Report in International Appln. No. PCT/KR2018/010048, dated Dec. 21, 2018, 4 pages.

European Office Action in European Application No. 18191623.0, dated Jun. 3, 2020, 4 pages.

*Primary Examiner* — Jason Y Ko

(74) *Attorney, Agent, or Firm* — Fish & Richardson P.C.

(57) ABSTRACT

Disclosed is a washing pump for spraying washing water or steam to wash dishes or cooking appliances, and a dishwasher including the same. The washing pump according to the present invention includes: a housing; a partition wall which is vertically divides an inner space of the housing; an impeller which is rotatably disposed over the partition wall in the housing to cause washing water to flow; a heater which is disposed under the partition wall to heat the washing water in the housing so as to generate steam; and a steam discharge pipe which is disposed over the partition wall to discharge the steam, generated by the heater, to an outside of the housing. Accordingly, steam may be generated by the heater and discharged.

11 Claims, 11 Drawing Sheets

WASHING PUMP AND DISHWASHER INCLUDING THE SAME

CROSS-REFERENCE TO RELATED APPLICATION

This application claims the priority benefit of Korean Patent Application No. 10-2017-0111509, filed on Aug. 31, 2017, in the Korean Intellectual Property Office, the disclosure of which is incorporated herein by reference.

FIELD

The present invention relates to a washing pump and a dishwasher including the same and, more particularly, to a washing pump for spraying washing water and steam to wash dishes and cooking appliances and a dishwasher including the same.

BACKGROUND

A dishwasher is a home appliance for washing foreign substance such as food waste remaining in a dish, a cooking appliance, and the like (hereinafter, referred to as a "target of washing") by high-pressure washing water sprayed from a spray arm.

The dishwasher generally consists of a tub forming a washing space, and a sump mounted to the bottom of the tub. In addition, the washing water moves to the spray arm by a pumping operation of the washing pump mounted in the sump. The washing water having moved to the spray arm is sprayed with high pressure through a spray hole formed in the spray arm. Then, the washing water sprayed with high pressure hits the surface of a target of washing to remove foreign substance remaining in the target of washing.

Meanwhile, the dishwasher wash the target of washing using heated washing water or supplies steam to the target of washing to wash or sterilize the target. An existing dishwasher usually generate hot water or steam by heating washing water, stored in the sump, with a heater provided in the sump. In this case, the heater should be exposed within the sump to contact washing water, so it is necessary to control a level of water in the sump not to expose the heater so as to prevent overheating of the heater. In addition, because heat can be exchanged only when the heater is in contact with the washing water, there are disadvantages that foreign substance remaining on the surface of the heater may degrade heat exchange efficiency and thus erodes the surface, thereby deteriorating durability of the heater.

SUMMARY

One object of the present invention is to provide a washing pump where a heater for heating washing water and a passage, through which steam generated by the heater is discharged, are arranged properly, and a dishwasher including the same.

Another object of the present invention is not limited to the aforementioned objects, and those skilled in the art will clearly understand non-mentioned other objects through the following description.

In one general aspect of the present invention, the above and other objects can be accomplished by the provision of a washing pump including: a housing; a partition wall which vertically divides an inner space of the housing; an impeller which is rotatably disposed over the partition wall in the housing to cause washing water to flow; a heater which is disposed under the partition wall to heat the washing water in the housing so as to generate steam; and a steam discharge pipe which is disposed over the partition wall to discharge the steam, generated by the heater, to an outside of the housing. Accordingly, steam may be generated by the heater and discharged.

The heater may be coupled to a bottom of the housing, and a part of the heater may be disposed inside the housing.

The heater may include: a heater cover which forms a bottom surface of the housing; and a heating element which is disposed in contact with a lower side of the heater cover to heat the heater cover.

A part of the heater cover may protrude upwardly to form a space where a part of the heating element is received.

The heater cover may be disposed between the washing water in the housing and the heating element.

The heater cover may be heated by the heating element to heat the washing water within the housing.

The washing pump may further include: a washing water inflow pipe through which the washing water flows into the housing by rotation of the impeller; and a washing water outflow pipe through which the washing water flows out of the housing by rotation of the impeller. The partition wall may be disposed between the washing water inflow pipe and the washing water outflow pipe.

The steam discharge pipe may be disposed in the washing water outflow pipe.

The steam discharge pipe may be disposed such that a steam discharge direction is vertical to a washing water outflow direction of the washing water outflow pipe.

The steam discharge pipe may be disposed over the washing water inflow pipe.

The heater may be disposed under the washing water inflow pipe.

In another general aspect of the present invention, the above and other objects can be accomplished by the provision of a dishwasher including: a tub which forms a washing space where a target of washing is received; a sump which is disposed under the tub to store washing water; a spray arm which sprays the washing water into the tub; a washing pump which pumps the washing water stored in the sump to the spray arm; a heater which heats the washing water in the washing pump so as to generate steam; a steam nozzle through which the steam generated by the heater is discharged into the tub; and a steam hose which connects the washing pump and the steam nozzle, wherein a portion of the steam hose being connected to the washing pump is disposed to be inclined upwardly.

The heater may be disposed under the bottom of the tub.

The heater may be disposed on one lateral side of the sump.

The washing pump may include: a partition wall which vertically divides an inner space; a pump upper portion which is disposed over the partition wall such that the washing water flows out to the spray arm; and a pump lower portion which is disposed under the partition such that the washing water flows into the pump lower portion, and the steam hose may be connected to the pump upper portion.

The dishwasher may further include a door which is provided at a front surface of the tub to open and close the washing space, and the steam nozzle may be provided at a lower end of the door.

A part of the steam hose may be disposed toward the lower end of the door along an edge of one lateral side of the bottom of the tub.

A part of the steam hose may be disposed to be inclined from a front of the bottom of the tub toward the lower end of the door.

Details of other embodiments will be described in the detailed description with reference to the accompanying drawings.

The washing machine and the dishwasher including the same according to the present invention provide at least the following effects.

First, the heater is disposed in the housing of the washing pump and able to effectively heat washing water with low energy.

Second, the steam discharge pipe through which steam is discharged from the washing pump is disposed at a higher position such that the steam is discharged smoothly without affecting the circulation of washing water.

Third, the steam hose is disposed appropriately such that steam flows smoothly to the steam nozzle.

Fourth, the steam discharge pipe through which steam is discharged is disposed appropriately such that a loss of generated steam in a circulation passage is minimized.

It should be understood that advantageous effects according to the present invention are not limited to the effects set forth above and other advantageous effects of the present invention will be apparent from the detailed description of the present invention.

BRIEF DESCRIPTION OF THE DRAWINGS

The embodiments will be described in detail with reference to the following drawings in which like reference numerals refer to like elements wherein.

DETAILED DESCRIPTION

Figure 1:
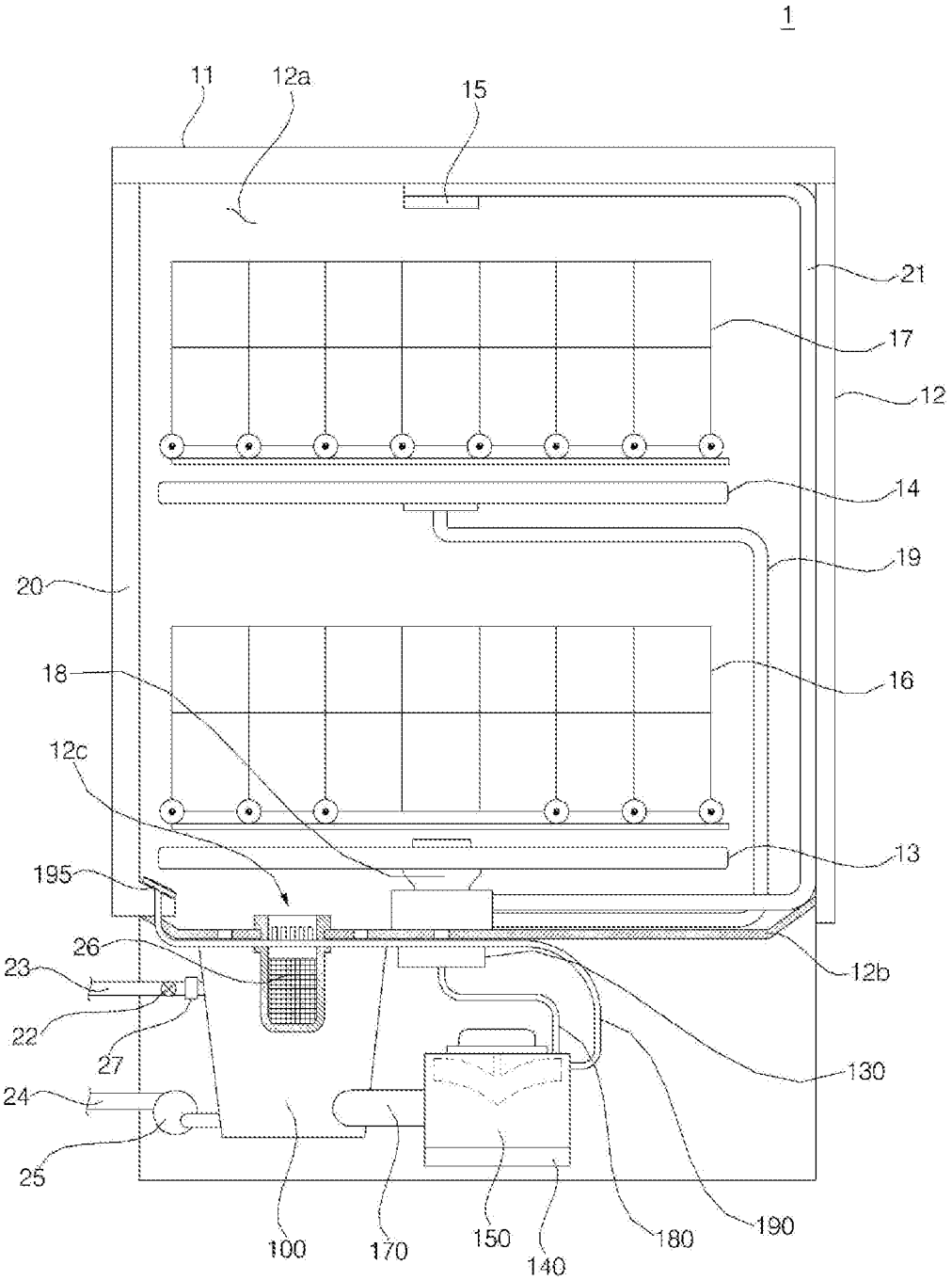
FIG. 1 is a schematic diagram illustrating a structure of a dishwasher according to an embodiment of the present invention.

Advantages and features and methods for achieving those of the present disclosure may become apparent upon referring to embodiments described later in detail with reference to the attached drawings. However, embodiments are not limited to the embodiments disclosed hereinafter and may be embodied in different ways. The embodiments are provided for perfection of disclosure and for informing persons skilled in this field of art of the scope. The same reference numerals may refer to the same elements throughout the specification.

Hereinafter, a washing pump and a dishwasher including the same according to embodiments of the present invention will be described with the accompanying drawings.

Figure 2:
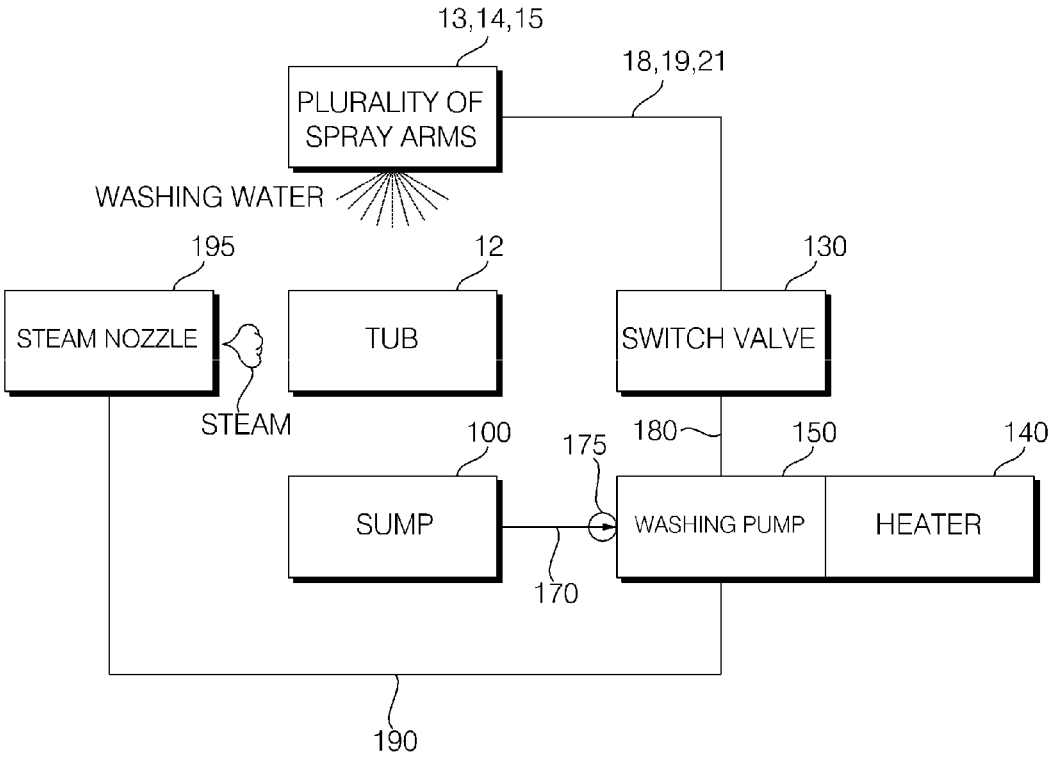
FIG. 2 is a diagram illustrating a configuration of a dishwasher according to an embodiment of the present invention.

FIG. 1 is a schematic diagram illustrating a structure of a dishwasher according to an embodiment of the present invention, and FIG. 2 is a diagram illustrating a configuration of a dishwasher according to an embodiment of the present invention.

A dishwasher 1 according to an embodiment of the present invention includes: a case 11 which forms an exterior of the dishwasher 1; a tub 12 which is provided inside the case 11 and forms a washing space 12*a* where a target of washing is received; a door 20 which is provided on a front surface of the tub 12 and used to open/close the washing space 12*a*; a sump 100 which is provided under the tub 12 to store washing water; a plurality of spray arms 13, 14, and 15 which spray washing water into the tub 12; a washing pump 150 which pumps washing water stored in the sump 100 to the plurality of spray arms 13, 14, and 15; a heater 140 which is disposed in a circulation passage, connecting the sump 100 and at least one of the plurality of spray arms 13, 14, and 15, to heat washing water; a steam nozzle 195 which is provided in the door 20 to discharge stream generated by the heater 140 to the washing space 12*a*; and a steam hose 190 which connects the washing pump 150 and the steam nozzle 195.

The tub 11 is in a hexagonal shape having an open front surface, and includes the washing space 12*a* formed therein. At a bottom 12*b* of the tub 11, a communication unit 12*c* through which washing water flows into the sump 100. A plurality of racks 16 and 17 where targets of washing are received is provided in the washing space 12*a*. The plurality of racks 16 and 17 includes a lower rack 16 disposed in a lower portion of the washing space 12*a*, and an upper rack 17 disposed in an upper portion of the washing space 12*a*. The lower rack 16 and the upper rack 17 may be spaced apart from each other, and may slide out in a forward direction from the tub 11 to be withdrawn.

The plurality of spray arms 13, 14, and 15 are disposed in an upward-downward direction. The plurality of spray arms 13, 14, and 15 includes: a lower spray arm 13 disposed lowest among the spray arms 13, 14, and 15 to spray washing water in an upward direction toward the lower rack 16; an upper spray arm 14 disposed over the lower spray arm 13 to spray washing water in an upward direction toward the upper rack 17; and a top spray arm 15 disposed at a top of the washing space 12*a*, which is positioned over the upper spray arm 14, to spray washing water in a downward direction.

The plurality of spray arms 13, 14, and 15 is supplied with washing water from the washing pump 150 through a plurality of spray arm connection passages 18, 19, and 21. The plurality of spray arm connection passages 18, 19, and 21 includes a low spray arm connection passage 18 connected to the lower spray arm 13, an upper spray arm connection passage 19 connected to the upper spray arm 14, and a top spray arm connection passage 21 connected to the top spray arm 15.

The sump 100 is disposed under the bottom 12*b* of the tub 12 and collects washing water. The sump 100 is connected to a water supply passage 23 in which washing water supplied from an external water source flows. A water supply valve 22 for controlling washing water supplied from the external water source is provided in the water supply passage 23. When the water supply valve 22 is opened, the washing water supplied from the external water source flows into the sump 100 through the water supply passage 23. The water supply passage 23 includes a flow meter 27 for measuring an amount of washing water flowing into the sump 100 through the water supply passage 23.

The sump 100 is connected to a drain passage 24 through which stored washing water is guided to an outside of the dish waster. A drain pump 25 for draining washing water from the sump 100 through the drain passage 24 is provided in the drain passage 24. When the drain pump 25 is driven, washing water stored in the sump 100 flows out of the case 11 through the drain passage 24.

A filter 26 is mounted at a communication hole 12*c*, and filters out foreign substances from washing water that flows from the tub 12 to the sump 100.

The washing pump 150 pumps washing water stored in the sump 100 to at least one of the plurality of spray arms 13, 14, and 15. The washing pump 150 is connected to a switch valve 130 and a washing water supply passage 180. When the washing pump 150 is driven, washing water stored in the sump 100 flows into the washing pump 150 through a water collection passage 170 and is then pumped to the switch valve 130 through a washing water supply passage 180. A check valve 175 is provided inside the water collection passage 170 or between the water collection passage 170 and the washing pump 150.

The washing pump 150 is installed on one lateral side of the sump 100. The washing pump 150 is connected to the steam hose 190. Steam generated in the washing pump 150 is supplied to the steam nozzle 195 through the stream hose 190.

The heater 140 is disposed in a circulation passage in which washing water flows from the sump 100 to at least one of the plurality of spray arms 13, 14, and 15, and the heater 150 heats the washing water. In this embodiment, a circulation passage means the water collection passage 170, the washing pump 150, the washing water supply passage 180, the switch valve 130, and at least one of the plurality of spray arms connection passages 18, 19, and 21. It is desirable that the heater 140 is disposed to heat washing water within the washing pump 150 in the circulation passage. It is desirable that the heater 140 is disposed between the sump 100 and the switch valve 130 in the circulation passage. In this embodiment, the heater 140 is coupled to the bottom of the washing pump 150.

The heater 140 generate hot water by heating washing water when the washing water flows in the circulation passage upon activation of the washing pump 150. When the washing pump 150 stops and the washing water does not flow in the circulation passage, the heater 140 generate steam by heating the washing water.

The hot water generated by the heater 140 flows along the circulation passage and is sprayed into the tub 12 through at least one of the plurality of spray arms 13, 14, and 15. The steam generated by the heater 140 flows along the steam hose 190 and is then discharged to the tub 12 through the steam nozzle 195.

The washing pump 150 and the heater 140 will be described with reference to FIGS. 3 to 6.

The steam nozzle 195 is provided at a lower end of the door 200 and discharges steam to the washing space 12*a*. The steam discharged from the steam nozzle 195 works on a target of washing received in the lower rack 16 and/or the upper rack 17. The steam hose 190 is branched from the circulation passage and connected to the steam nozzle 195. It is desirable that the steam hose 190 is connected to the washing pump 150 in the circulation passage.

The switch valve 130 is disposed within the circulation passage, and selectively connects the sump 100 to at least one of a plurality of spray arms 13, 14, and 15. The switch valve 130 selectively supplies washing water, pumped by the washing pump 150, to at least one of the low spray arm 13, the upper spray arm 14, or the top spray arm 15. The switch valve 130 selectively connects the washing water supply passage 180 to at least one of the plurality of spray arm connection passage 18, 19, and 21. The switch valve 130 may be disposed in the sump 100.

The check valve 175 is disposed between the sump 100 and the washing pump 150 and is capable of being opened in a direction from the sump 100 to the washing pump 150. The check valve 175 is opened to allow washing water to flow from the sump 100 to the washing pump 150, and the check valve 175 is closed not to allow stream to flow from the washing pump 150 to the sump 100. A lower portion of the check valve 175 is rotated relative to an upper portion of the check valve 175 such that the check valve 175 is opened. The check valve 175 is disposed inside the water collection passage 170 or connected between the water collection passage 170 and the washing pump 150 so as to open and close the water collection passage 170.

The check valve 175 is closed when the heater 140 generates steam. When washing water flows upon operation of the washing pump 150, the check valve 175 is opened. When washing water stops flowing upon deactivation of the washing pump 150, the check valve 175 is closed. The check valve 175 is opened by pressure of washing water pumped by the washing pump 150. In some implementations, the check valve 175 may be a solenoid valve that is opened and closed in accordance with an electronic signal.

The check valve 175 is formed to allow washing water to flow from the washing pump 150 to the sump 100 even in a closed state while the drain pump 25 operates.

Figure 3:
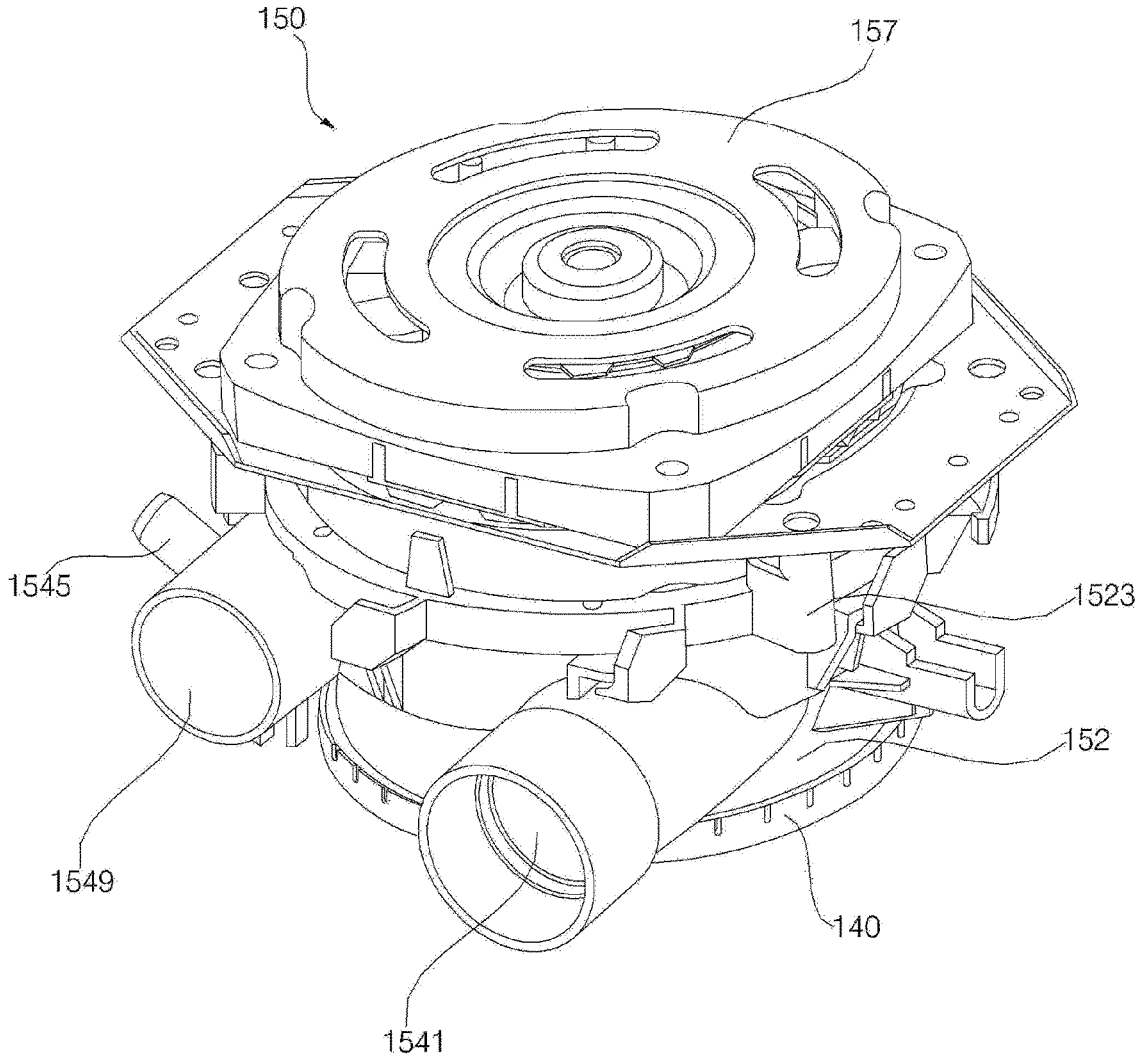
FIG. 3 is a perspective view of a washing pump and a heater according to an embodiment of the present invention
Figure 4:
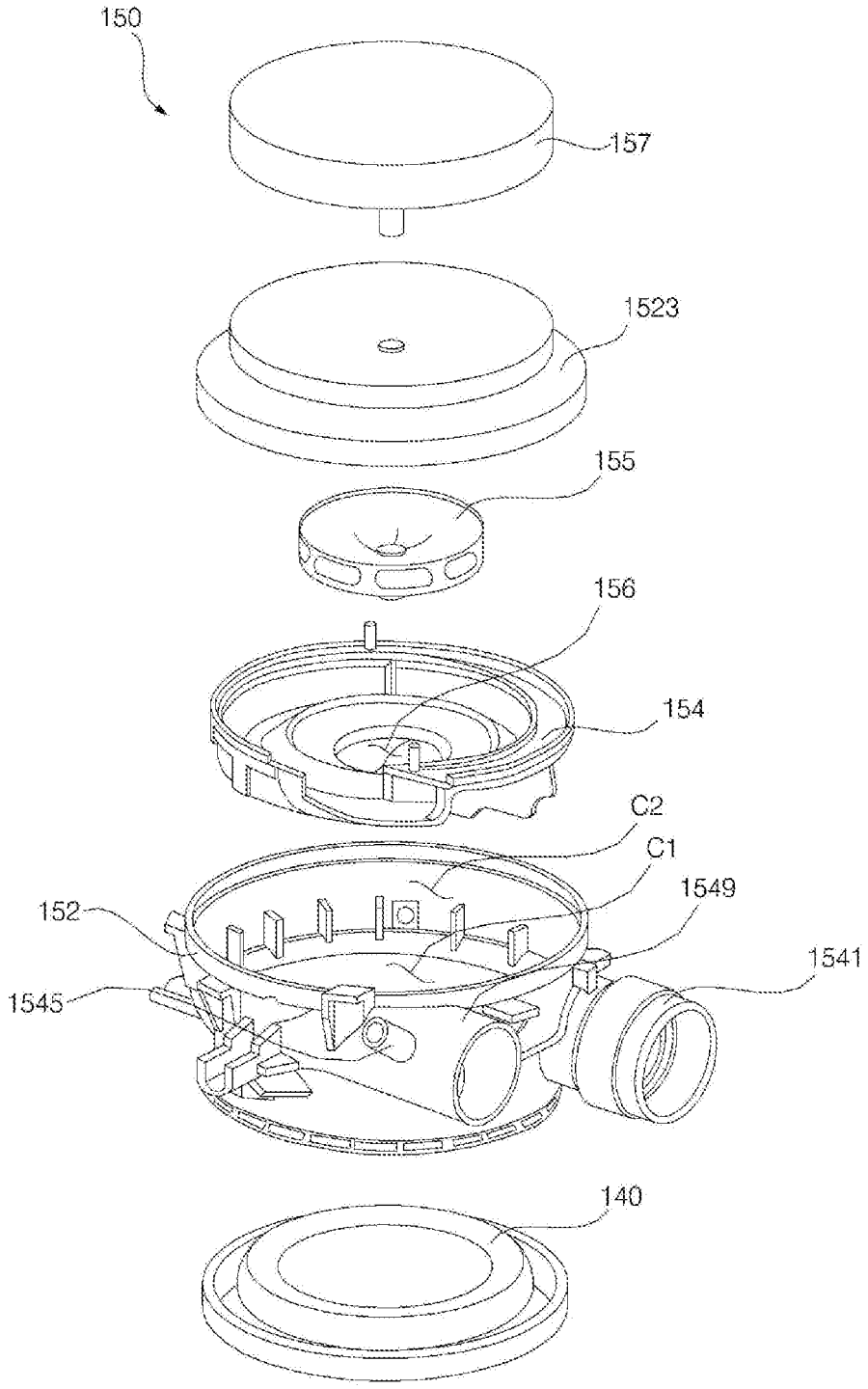
FIG. 4 is an exploded perspective view of a washing pump and a heater according to an embodiment of the present invention.
Figure 5:
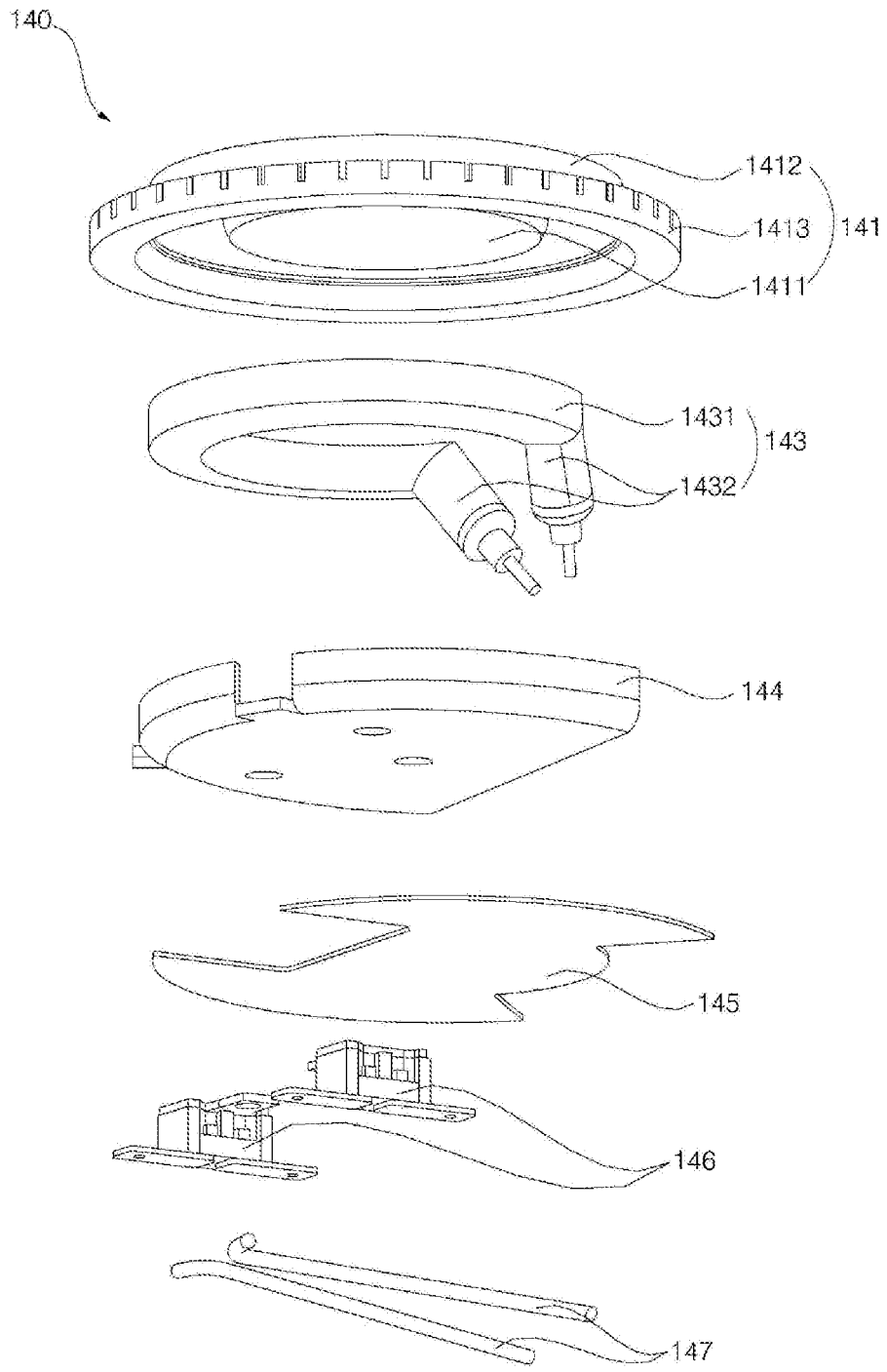
FIG. 5 is an exploded perspective view of a heater according to an embodiment of the present invention.
Figure 6:
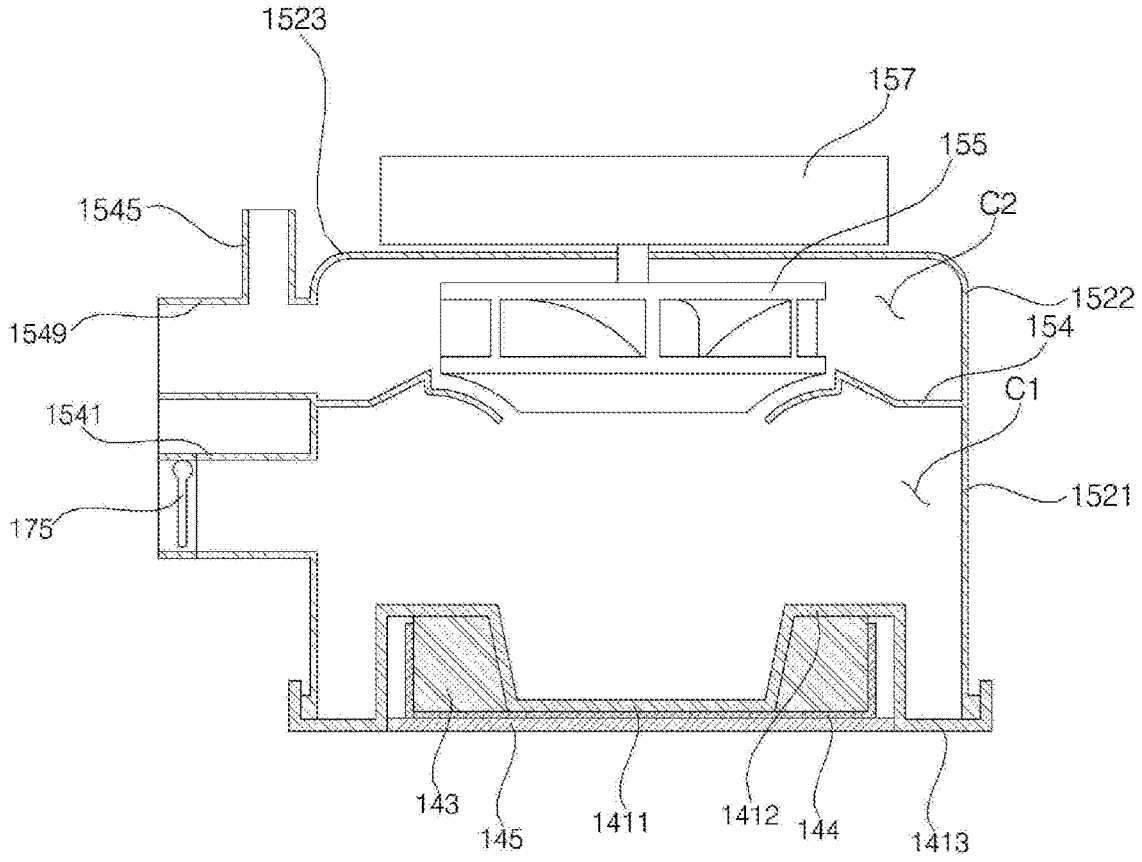
FIG. 6 is a schematic cross-sectional view of a washing pump according to an embodiment of the present invention.

FIG. 3 is a perspective view of a washing pump and a heater according to an embodiment of the present invention, and FIG. 4 is an exploded perspective view of a washing pump and a heater according to an embodiment of the present invention. FIG. 5 is an exploded perspective view of a heater according to an embodiment of the present invention, and FIG. 6 is a schematic cross-sectional view of a washing pump according to an embodiment of the present invention.

A washing pump 150 according to an embodiment of the present invention includes: a cylindrical housing 152 which is coupled to a sump 100; a washing water inflow pipe 1541 which is connected to the housing 152, and through which washing water flows into the housing 152 by rotation of an impeller 155; a washing water outflow pipe 1549 which is connected to the housing 152, and through which washing water flows out of the housing 152 by rotation of the impeller 155; the rotatable impeller 155 which is disposed inside the housing 152 to pump washing water flown into the washing water inflow pipe 1541 to the washing water outflow pipe 1549; a motor 157 which rotates the impeller 155; and a steam discharge pipe 1545 which is disposed in the washing water outflow pipe 1549 to discharge steam generated by the heater 140.

The housing 152 is formed in a cylindrical shape with a top surface and a bottom surface which are open. The housing 152 is coupled to the sump 100. A top of the housing 152 is coupled to a housing cover 1523, and a bottom of the housing 152 is coupled to the heater 140. The housing cover 1523 covers the top of the housing 152, and the motor 157 generating a rotational force to rotate the impeller 155 is provided in the housing cover 1523.

A partition wall 154 is disposed inside the housing 152. The partition wall 154 is disposed at the middle end of the housing 152 to vertically divide an inner space. The partition wall 154 is disposed under the impeller 155. The partition wall 154 is disposed over the washing water inflow pipe 1541 and under the washing water outflow pipe 1549. The partition wall 154 forms a lower chamber C1 and an upper chamber C2 in the housing 152. The lower chamber C1 is a space where negative pressure is generated by rotation of the impeller 155, and the upper chamber C2 is a space where the impeller 155 is received and positive pressure is generated by rotation of the impeller 155. The lower chamber C1 is connected to the sump 100 through a water collection passage 170 and the washing water inflow pipe 1541. The upper chamber C2 is connected to a switch valve 130 through the washing water outflow pipe 1549 and a washing water supply passage 180. In addition, the upper chamber C2 is connected to the steam nozzle 195 through the steam discharge pipe 1545 and a steam hose 190.

The partition wall 154 divides the washing pump 150 into a pump lower portion 1521, into which washing water enters by rotation of the impeller 155, and a pump upper portion 1522 from which washing water is discharged by rotation of the impeller 155. Washing water enters into the pump lower portion 1521, and the lower chamber C1 is formed in the pump lower portion 1521. The pump lower portion 1521 includes a lower portion of the housing 152 and the washing water inflow pipe 1541. The pump lower portion 1521 may further include a heater cover 151 of the heater 140.

The pump upper portion 1522 discharges washing water or steam to an outside, and the upper chamber C2 is formed in the pump upper portion 1522. The pump upper portion 1522 includes an upper portion of the housing 152, the washing water outflow pipe 1549, the steam discharge pipe 1545, and the housing cover 1523. The impeller 155 is disposed inside the pump upper portion 1522, and the motor 157 is disposed over the pump upper portion 1522.

A partition wall hole 156 through which the lower chamber C1 and the upper chamber C2 communicates each other is formed in the partition wall 154. A surface of the partition wall 154 facing the upper chamber C2 is in a volute form to guide washing water, which has entered into the upper chamber C2 from the lower chamber C1 through the partition wall 156, to the washing water outflow pipe 1549. A guider (not shown) protruding downwardly is formed in a bottom surface of the partition wall 154 facing the lower chamber C1. The guider of the partition wall 154 guides washing water, which has entered into the lower chamber C1 through the washing water inflow pipe 1541, to the partition wall hole 156. The guider of the partition wall 154 allows washing water in the lower chamber C1 to be uniformly heated by the heater 140.

The impeller 155 rotates by the motor 157 to cause washing water in the housing 152 to flow such that the washing water is pumped to an outside of the housing 152. The impeller 155 is rotatably disposed inside the upper chamber C2. The impeller 155 pumps washing water, which has entered from the lower chamber C1 into the upper chamber C2 through the partition wall 156, to the washing water outflow pipe 1549.

The washing water inflow pipe 1541 is connected to one side of the lower chamber C1 of the housing 152. The washing water inflow pipe 1541 is connected to the water collection passage 170 such that washing water in the sump 100 flows into the lower chamber C1. The washing water inflow pipe 1541 is disposed to protrude outward from a lower side wall of the housing 152. The washing water inflow pipe 1541 is disposed in a horizontal direction.

The washing water outflow pipe 1549 is connected to the upper chamber C2 of the housing 152. The washing water outflow pipe 1549 is connected to the washing water supply passage 180 such that washing water in the upper chamber C2 outflows to the washing water supply passage 180. The washing water outflow pipe 1549 is disposed to protrude outward from an upper side wall of the housing 152. The washing water outflow pipe 1549 is disposed in a horizontal direction, so that a washing water outflow direction is horizontal. The washing water outflow pipe 1549 is disposed higher than the washing water inflow pipe 1541. A washing water outflow direction of the washing water outflow pipe 1549 is opposite to a washing water inflow direction of the washing water inflow pipe 1541.

The steam discharge pipe 1545 is connected to one side of the upper chamber C2 of the housing 152. The steam discharge pipe 1545 is disposed over the partition wall 154. The steam discharge pipe 1545 may be disposed at any of various positions in the housing 152 so as to connect the upper chamber C2 of the housing 152 and the steam hose 190, and, in this embodiment, the steam discharge pipe 1545 is disposed in the washing water outflow pipe 1549. The steam discharge pipe 1545 is disposed to be inclined such that a steam discharge direction is inclined upwardly. The steam discharge direction of the steam discharge pipe 1545 is vertical to a washing water outflow direction of the washing water outflow pipe 1549.

As the steam discharge pipe 1545 is connected to the steam hose 190, the steam discharge pipe 1545 discharges steam, generated by the heater 140 in the housing 152, to the steam hose 190. The steam hose 190 is connected between the impeller 155 and the switch valve 130 in the circulation passage through the steam discharge pipe 1545, and it is desirable that the steam hose 190 is connected to the upper chamber C2.

The heater 140 is disposed between the sump 100 and the impeller 155 in the circulation passage, and it is desirable that the heater 140 is connected between the water collection passage 170 and the impeller 155. It is desirable that the heater 140 is coupled to one side of the housing 152 so as to be coupled to the lower chamber C1. The heater 140 is connected to the bottom of the housing 152 to form a bottom surface of the housing 152. When the impeller 155 rotates, the heater 140 heats washing water that is flowing in the housing 152. Then, when the impeller 155 stops rotating, the heater 140 generates steam by heating washing water in the housing 152. The heater 140 is disposed under the washing water inflow pipe 1541. The heater 140 is disposed under the partition wall 154. A part of the heater 140 is disposed inside the housing 152.

The check valve 175 is coupled to the washing water inflow pipe 1541. An upper end of the check valve 175 is coupled to an upper end of the washing water inflow pipe 1541. The check valve 175 is opened when the impeller 155 rotates, and the check valve 175 is closed when the impeller 155 stops rotating. The check valve 175 is opened when the motor 157 operates, and the check valve 175 is closed when the motor 157 stops operating. The check valve 175 is closed when the heater 140 generate steam, so that the steam generated in the housing 152 is prevented from leaking to the sump 100 through the lower chamber C1 and the washing water inflow pipe 1541.

The check valve 175 is formed to allow washing water to flow from the washing pump 150 to the sump 100 when the discharge pump 25 operates. When the check valve 175 is closed, a part of a lower portion of the washing water inflow pipe 1541 is opened. The check valve 175 covers 50% to 90%, preferably 70%, of a cross-sectional area of the washing water inflow pipe 1541 when the check valve 175 is closed.

While the heater 140 generates steam, the check valve 175 is closed not to allow washing water or the steam to flow from the washing pump 150 to the sump 100. When the drain pump 25 and the motor 157 stop (when they stop operating), the check valve 175 stores washing water in the housing 152. The heater 140 generates steam by heating the washing water, stored in the housing 152, by the check valve 175.

The heater 140 according to an embodiment of the present invention includes: a heater cover 141 which forms a bottom surface of the housing 152; a heating element 143 which is disposed in contact with a lower side of the heater cover 141 to heat the heater cover 141; a heater plate 144 which is disposed in contact with a lower side of the heating element 143 and the heater cover 141 to transfer heat of the heating element 143 to the heater cover 141; a thermostat 146 which supplies power to the heating element 143 and adjusts temperature of the heating element 143; a wire 147 which electronically connects the heating element 143 and the thermostat 143 with each other; and a heater shield 145 which is disposed under the heater plate 144 to cover a part of the heater plate 144.

The heater cover 141 is coupled to the bottom of the housing 152 to form a bottom surface of the housing 152 of the washing pump 150. A top surface of the heater cover 141 comes into contact with washing water. The heating element 143 and the heater plate 144 are bonded to the bottom of the heater cover 141. The heater cover 141 is heated by the heating element 143 and the heater plate 144 to heat washing water.

A circumference of the heater cover 141 is formed in a circular shape, and has a plurality of vertical bends on a concentric circle. A part of the heater cover 141 is in a ring shape protruding upwardly (toward the partition wall 154 of the washing pump 150). A part of the heater cover 141 protrudes inward of the housing 152 to form a ring-shaped space where a part of the heating element 143 is received. A part of the heater cover 141 is disposed between washing water received in the housing 152 and the heating element 143. Accordingly, the heating element 143 is not brought into contact with the washing water received in the housing 152.

The heater cover 141 includes a cover base 1411 in a disk shape, a cover holder 1412 protruding upwardly from a circumference of the cover base 1411, and a cover rim 1413 formed on a circumference of the cover holder 1412 to be coupled to the housing 152.

The cover base 1411 is in a disk shape to form a central portion of the heater cover 141. A central portion of the heater plate 144 is bonded to a bottom of the cover base 1411. The cover base 1411 and the central portion of the heater plate 144 are bonded by brazing.

The cover holder 1412 is formed in a ring shape protruding upwardly. The cover holder 1412 forms a ring-shaped space where a part of the heating element 143 is received. A main heating element 1431 of the heating element 143, which will be described later on, is received in the ring-shaped space of the cover holder 1412. A part of the heating element 143 is bonded to the inside of the cover holder 1412. The cover holder 1412 and the part of the heating element 143 are bonded by brazing.

The cover holder 1412 is formed by an open curve such that a vertical cross-section in a radial direction from the center of the cover holder 1412 has an open bottom. At least a part of the cover holder 1412 is formed to correspond to a shape of a part of the heating element 143, the part of the heating element 143 being received in the ring-shaped space of the cover holder 1412. The cover holder 1412 directly contact the part of the heating element 143, while receiving the part of the heating element 143. An internal surface of an external circumference of the cover holder 1412 is spaced apart from a partial external circumferential surface of the heating element 143, the part of the heating element 1413 being received in the ring-shaped space of the cover holder 1412.

The cover rim 1413 is in a rim shape. The cover rim 1413 is formed to surround a circumference of the bottom of the housing 152. A peripheral edge of the cover rim 1413 protrude upwardly to be coupled to the housing 152. Since the cover rim 1413 is not brought into contact with the heater plate 144 and the heating element 143, the cover rim 1413 is heated to a relatively lower temperature.

The heating element 143 generates heat by being supplied with power from the thermostat 146 through the wire 147. The heat element 143 heats the heater cover 141 and the heater plate 144. The heater cover 141 is bonded to a top of the heating element 143 *d* by brazing, and the heater plate 144 is bonded to the bottom of the heat element 143 by brazing.

A partial external circumference of the heating element 143 is spaced apart from a part of the heater cover 141, which forms a ring-shaped space. The part of the heating element 143 is received within the ring-shaped space formed in the heater cover 141 and disposed inside the housing 152. Since the heating element 143 is disposed under the heater cover 141 which forms the bottom surface of the housing 152, the heating element 143 is disposed outside the washing pump 150 while a part of the heating element 143 is disposed inside the housing 152.

The heating element 143 includes the main heating element 1431 which generates heat and which is in an arc shape, and a heating terminal 1432 which supplies power to the heating main body 1431.

The main heating element 1431 is formed in a large arc shape with a central angle of 180° or greater. The main heating element 1431 is received within the cover holder 1412. A top surface and an internal circumferential surface of the main heating element 1431 are brought into contact with the heater cover 141 and heat the heater cover 141. A bottom surface and an external circumferential surface of the main heating element 141 are brought into contact with the heater plate 144 and heat the heater plate 144. The main heating element 1431 is disposed higher than the bottom of the housing 152.

The heating terminal 1432 is supplied with power from the thermostat 146 through the wire 147 and transfers the power to the main heating element 1431. The heating terminal 1432 is provided as a plurality of heating terminals at both ends of the main heating element 1431. A plurality of heating terminals 1431 extends from the both ends of the main heating element 1431 to be inclined downwardly. That is, the plurality of heating terminal 1432 protrudes downwardly from a plane that is formed by a bottom of the main heating element 1431.

The heater plate 144 is heated by the heating element 143 to heat the cover base 1411 of the heater cover 141. The heater plate 144 uniformly distributes heat of the heating element 143 to thereby uniformly heat the heater cover 141.

The heater plate 144 is formed in a bowl shape. An internal circumferential surface of the heater plate 144 is brought into contact with the heating element 143, but an external circumferential surface of the heater plate 144 is spaced apart from the heater cover 141. The heater shield 145 is disposed under the heater plate 144.

Figure 7:
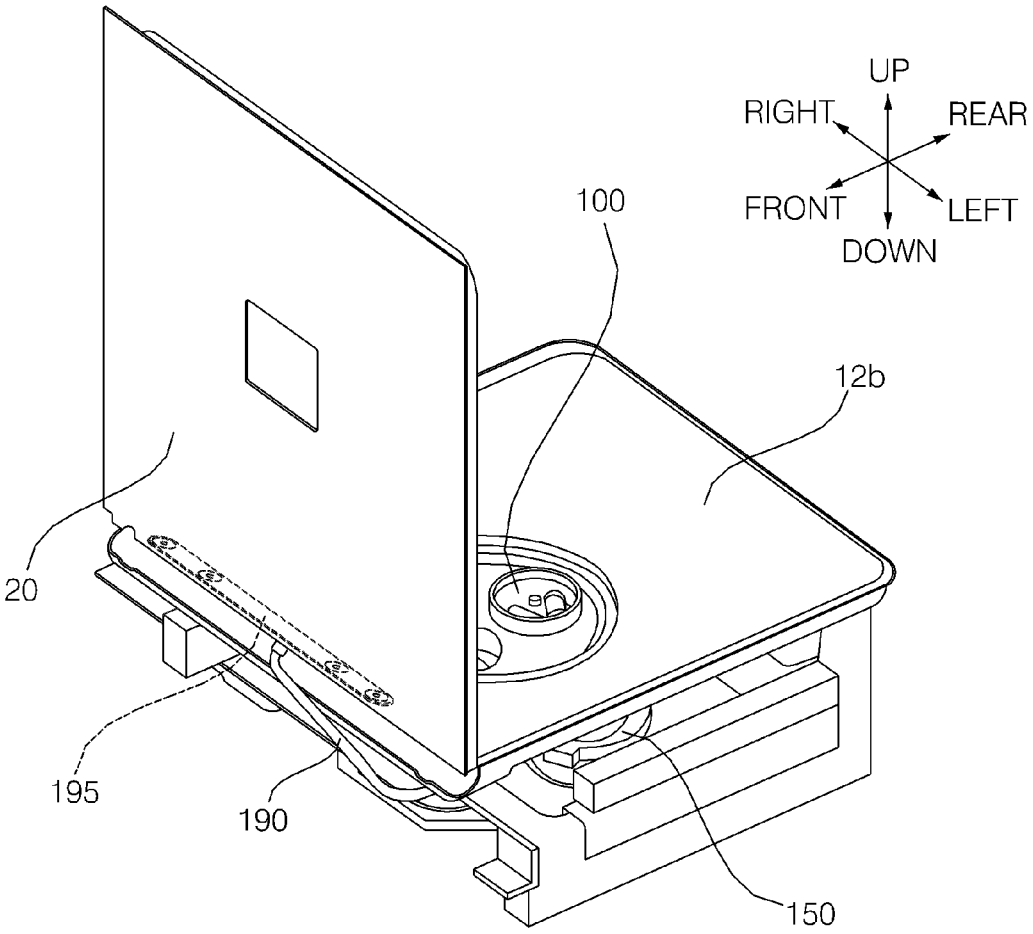
FIG. 7 is a perspective view of a part of a dishwasher according to an embodiment of the present invention.
Figure 8:
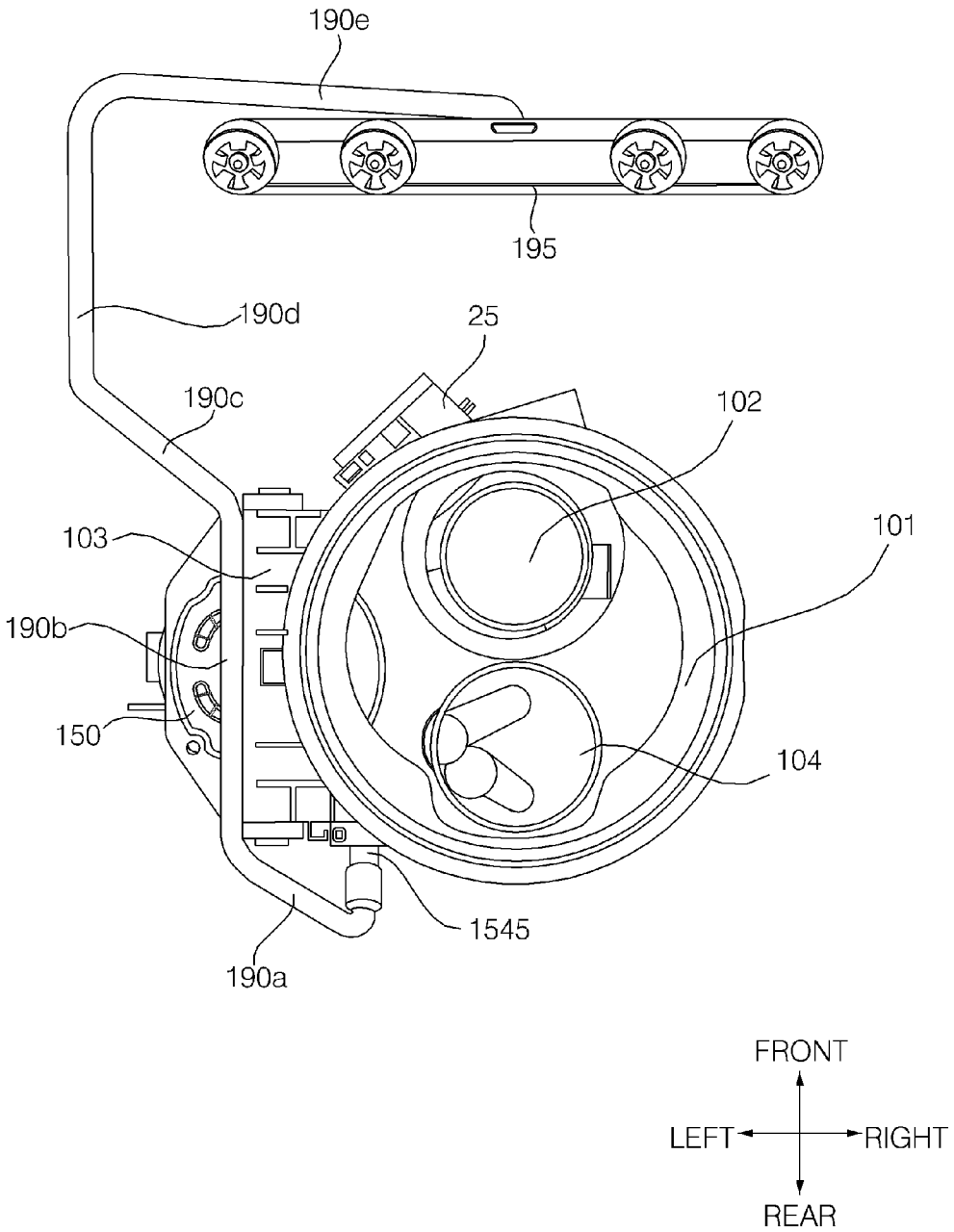
FIG. 8 is a plan view of a part of a dishwasher according to an embodiment of the present invention.
Figure 9:
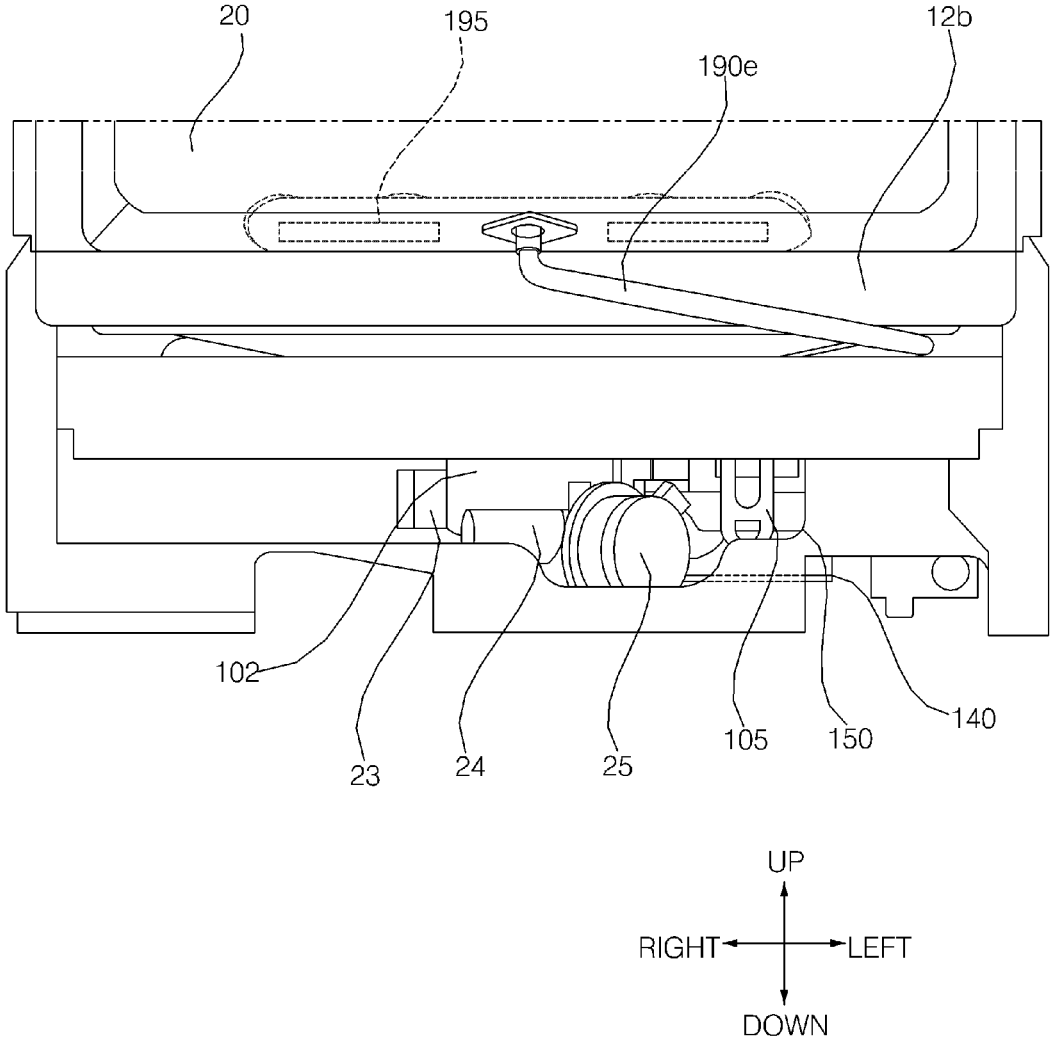
FIG. 9 is a front view of a part of a dishwasher according to an embodiment of the present invention.
Figure 10:
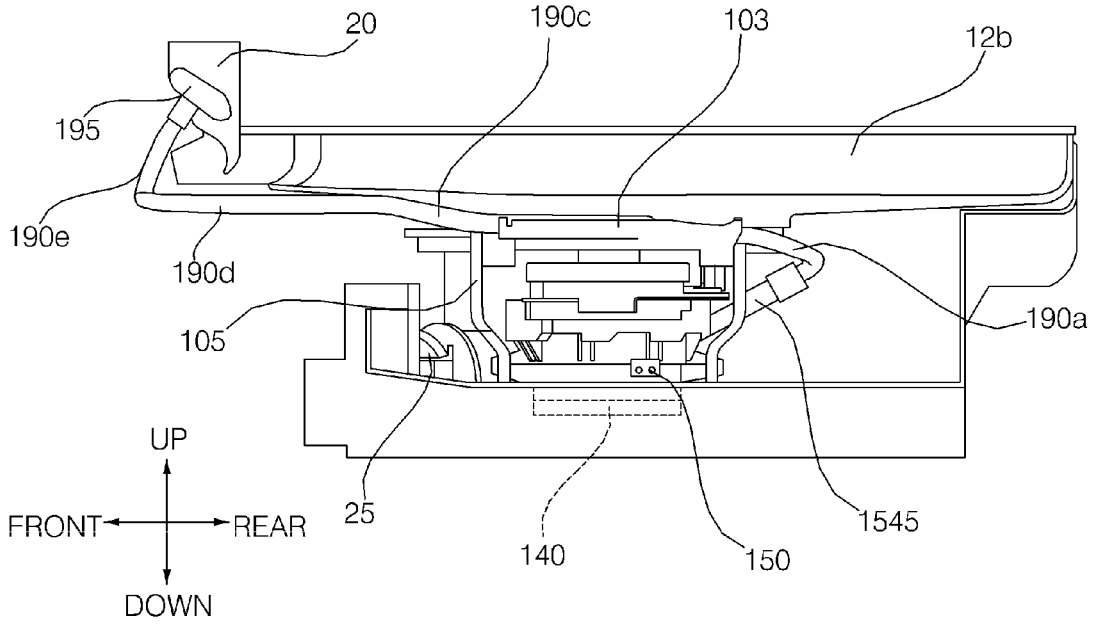
FIG. 10 is a left-side view of a part of a dishwasher according to an embodiment of the present invention.
Figure 11:
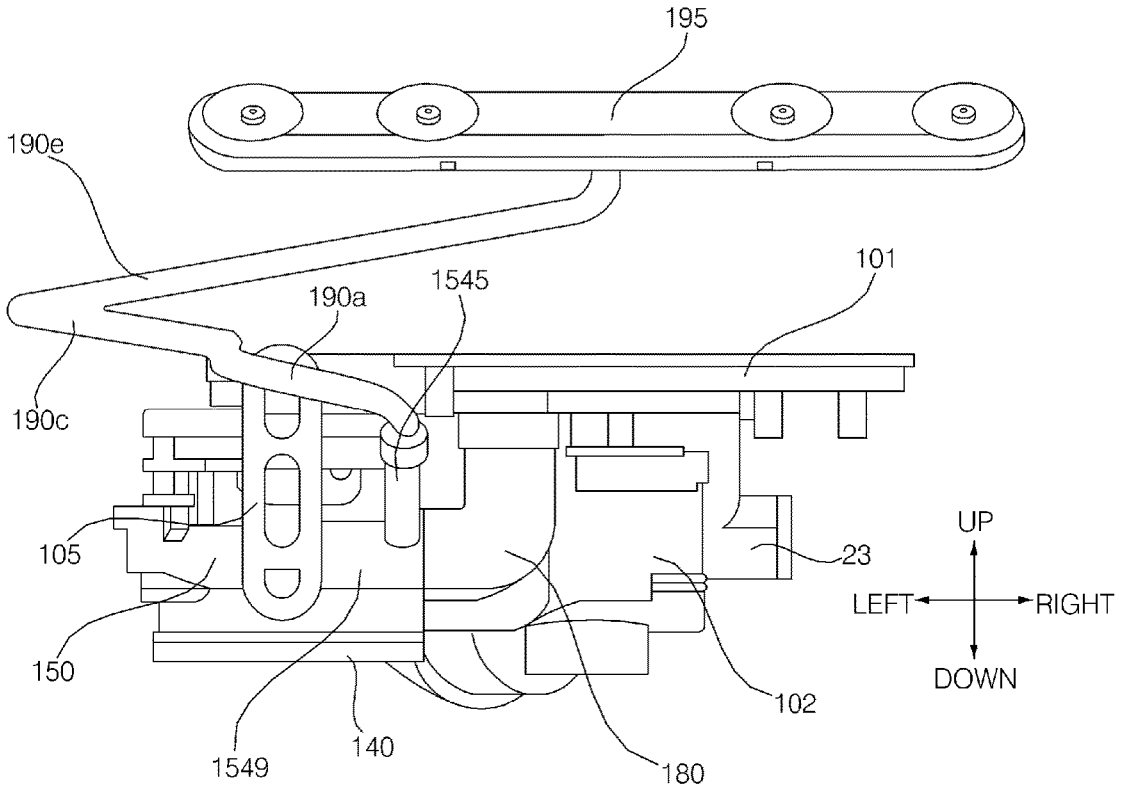
FIG. 11 is a rear view of a part of a dishwasher according to an embodiment of the present invention.

FIG. 7 is a perspective view of a part of a dishwasher according to an embodiment of the present invention, FIG. 8 is a plan view of a part of a dishwasher according to an embodiment of the present invention, FIG. 9 is a front view of a part of a dishwasher according to an embodiment of the present invention, FIG. 10 is a left-side view of a part of a dishwasher according to an embodiment of the present invention, and FIG. 11 is a rear view of a part of a dishwasher according to an embodiment of the present invention.

Hereinafter, a direction in which the door 20 is arranged with reference to the center of the dishwasher 1 is a forward direction, and an opposite direction to the forward direction is a rearward direction. In addition, a direction vertical to the forward-rearward direction on a horizontal plane is a left-right direction (a lateral direction), and a direction in which the washing pump 150 is disposed with reference to the center of the dishwasher 1 is a left lateral direction, and an opposite direction to the left lateral direction is a right lateral direction.

The sump 100 according to an embodiment of the present invention includes: a sump body 101 coupled to a bottom 12*b* of the tub 12; a water collection unit 102 in which washing water is collected; a steam hose supporter 103 extending in a horizontal direction from the sump body 101 and supporting the steam hose 190; a valve coupling portion 104 in which the switch valve 130 is disposed; and a washing pump connection member 105 connecting the steam hose supporter 103 and the washing pump 150.

The sump body 101 is disposed under a central portion of the bottom 12*b* of the tub 12 and coupled to the tub 12. The sump body 101 is roughly in a disk shape. A slope for guiding washing water to the water collection unit 102 may be formed on a top surface of the sump body 101.

The water collection unit 102 is formed in a cylindrical shape to store collected washing water. The water collection unit 102 is disposed under a communication hole 12C of the tub 12 to correspond to the communication hole 12*c*. The water collection unit 102 receives a part of a filter 26. The water supply passage 23 is connected to the water collection unit 102 such that washing water supplied from an external water supply source enters into the water collection unit 102. The water collection unit 102 includes a drain pump 25 mounted therein and is connected to the drain passage 24 such that washing water in the water collection unit 102 flows out of the water collection unit 102 through the drain passage 24. The water collection unit 102 is connected to the water collection passage 170 such that washing water in the water collection unit 102 flows out of the water collection unit 102 through the water collection passage 170.

In the valve coupling portion 104, the switch valve 130 is provided. The valve coupling portion 104 may be a part of the switch valve 130. The valve coupling portion 104 is roughly in a circular shape. A supply hole 104*a* communicating with the washing water supply passage 180 is formed in the valve coupling portion 104.

The steam hose supporter 103 extends in a horizontal direction from a side of the sump body 101 to thereby support the steam hose 190. A part of the steam hose 190 is arranged on a top surface of the steam hose supporter 103. The steam hose supporter 103 is connected to the washing pump connection member 105 to thereby support the washing pump 150. The steam hose supporter 103 is disposed higher than an upper end of the steam discharge pipe 1545 of the washing pump 150 and lower than a lower end of the steam nozzle 195. The steam hose supporter 103 is disposed to cover at least a part of an upper side of the washing pump 150, especially at least a part of the upper side of the motor 157 of the washing pump 150.

The washing pump connection member 105 fixes the washing pump 150 to the sump 100. The washing pump connection member 105 may be provided as a plurality of washing pump connection members 105. An upper end of the washing pump connection member 105 is connected to the steam hose supporter 103, and a lower end of the washing pump connection member 105 is connected to the housing 152 of the washing pump 150.

In this embodiment, the water collection unit 102 and the valve coupling portion 104 are arranged in the sump body 101 in the forward-rearward direction. The water collection unit 102 is disposed in front of the valve coupling portion 104. The washing pump 150 is disposed on one lateral side of the sump 100. In this embodiment, the washing pump 150 is disposed on the left side of the sump 100. That is, the washing pump 150 is disposed on the left side of the water collection unit 102 and the valve coupling portion 104.

The washing pump 150 is disposed under the bottom 12*b* of the tub 120. The washing water inflow pipe 1541 and the washing water outflow pipe 1549 of the washing pump 150 are disposed to face the sump 100. The washing water inflow pipe 1541 is disposed to face the water collection unit 102, and the washing water outflow pipe 1549 is disposed to face the valve coupling portion 104. The washing water inflow pipe 1541 is disposed such that washing water flows in from a left direction, and the washing water outflow pipe 1549 is disposed such that washing water flows out in a right direction. The steam discharge pipe 1545 of the washing pump 150 is disposed such that steam is discharged in an upward-rearward direction.

The heater 140 is disposed under the bottom 12*b* of the tub 12. The heater 140 is disposed under the washing pump 150. The heater 140 is disposed on one side of the sump 100. In this embodiment, the heater 140 is disposed on the left side of the sump 100. That is, the heater 140 is disposed on the left side of the water collection unit 102 and the valve coupling portion 104.

The steam hose 190 is disposed such that one end thereof is disposed on one side of the sump 100 and the other end thereof is disposed in front of the sump 100. The steam horse 190 is connected between the impeller 155 and the switch valve 130 in the circulation passage. In this embodiment, the steam hose 190 is connected to the upper chamber C2 of the washing pump 150 through the steam discharge pipe 1545 of the washing pump 150. One end of the steam hose 190 is disposed under the bottom 12*b* of the tub 12, and the steam hose 190 extends under the bottom 12*b* of the tub 12 in a forward direction from the bottom 12*b* of the tub 12 such that the other end of the steam hose 190 is connected to the steam nozzle 195 disposed at the door 20. The steam hose 190 is not disposed over the bottom 12*b* of the tub 12.

The steam hose 190 is disposed to be inclined upwardly from the washing pump 150 with reference to a steam flow direction, or disposed to face a horizontal direction. That is, the steam hose 190 is disposed not to have a portion that is inclined downwardly with reference to the steam flow direction.

The steam hose 190 includes: a first steam hose portion 190*a* of which one end is connected to the steam discharge pipe 1545 of the washing pump 150, and which is disposed to be inclined upwardly with reference to a steam flow direction; a second steam hose portion 190*b* which is bent from the first steam hose portion 190*a* to be horizontally disposed forward with reference to the steam flow direction, and which is disposed on a top surface of the steam hose supporter 103; a third steam hose portion 190*c* which is bent from the second steam hose portion 190*b* to be inclined forwardly and laterally (the left direction in this embodiment) with reference to the steam flow direction; a fourth steam hose portion 190*d* which is bent from the third steam hose portion 190*c* to be horizontally disposed forward with reference to the steam flow direction; and a fifth steam hose portion 190*e* which is bent from the fourth steam hose portion 190*d* to be inclined upwardly with reference to the steam flow direction and connected to the steam nozzle 195.

The first steam hose portion 190*a* is inclined toward the steam hose supporter 103 from one end which is connected to the steam discharge pipe 1545. The second steam hose portion 190*b* is supported by the steam hose supporter 103 to be horizontally disposed forward along an edge of one lateral side (the left side in this embodiment) of the sump 100. The third steam hose portion 190*c* is disposed upwardly while inclined laterally toward an edge of one lateral side (the left side in this embodiment) of the bottom 12*b* of the tub 12. The fourth steam hose portion 190*d* is horizontally disposed below and along an edge of one lateral side (the left side in this embodiment) of the bottom 12*b* of the tub 12. The fifth steam hose portion 190*e* is disposed in front of the bottom 12*b* of the tub 12 to be inclined toward the steam nozzle 195 disposed at a lower end of the door 20. The fifth steam hose portion 190*e* is disposed to cross the front of the bottom 12*b* of the tub 12.

Although the exemplary embodiments have been illustrated and described, embodiments are not limited to the above-described particular embodiments, various modifications are possible by those skilled in the art without departing from the scope and spirit as disclosed in the accompanying claims and these modifications should not be understood separately from the scope and spirit.

What is claimed is:

1. A washing pump comprising:

a housing configured to receive washing water;

a partition wall that divides an inner space of the housing;

an impeller that is located vertically above the partition wall, that is configured to rotate relative to the housing, and that is configured to cause flow of washing water;

a heater that is located vertically below the partition wall, that is configured to heat washing water in the housing, and that is configured to generate steam from washing water in the housing;

a washing water inflow pipe configured to receive washing water into the housing based on rotation of the impeller;

a washing water outflow pipe configured to discharge washing water from the housing based on rotation of the impeller; and a steam discharge pipe that is disposed on a circumferential surface of the washing water outflow pipe, that is located vertically above the partition wall, and that is configured to discharge steam generated by the heater to an outside of the housing, wherein the partition wall is located between the washing water inflow pipe and the washing water outflow pipe.

2. The washing pump of claim 1, wherein the heater is configured to couple to a bottom of the housing, and wherein a part of the heater is located inside of the housing.

3. The washing pump of claim 1, wherein the heater comprises:

a heater cover that defines a bottom surface of the housing; and a heating element configured to contact a lower side of the heater cover to heat the heater cover.

4. The washing pump of claim 3, wherein a part of the heater cover protrudes upward from the bottom surface of the housing to define a space configured to receive a part of the heating element.

5. The washing pump of claim 3, wherein the heater cover is configured to be positioned between washing water in the housing and the heating element.

6. The washing pump of claim 3, wherein the heater cover is configured to, based on being heated by the heating element, heat washing water in the housing.

7. The washing pump of claim 1, wherein the steam discharge pipe extends from the washing water outflow pipe.

8. The washing pump of claim 1, wherein the washing water outflow pipe is configured to discharge washing water in a washing water outflow direction, and wherein the steam discharge pipe is configured to discharge steam in a steam discharge direction that is perpendicular to the washing water outflow direction.

9. The washing pump of claim 1, wherein the steam discharge pipe is located vertically above the washing water inflow pipe.

10. The washing pump of claim 1, wherein the heater is located vertically below the washing water inflow pipe.

11. The washing pump of claim 1, wherein the steam discharge pipe extends from the circumferential surface of the washing water outflow pipe in a radial direction of the washing water outflow pipe.

* * * * *